US005477629A

United States Patent [19]

Gleason, Jr.

[11] Patent Number: 5,477,629

[45] Date of Patent: Dec. 26, 1995

[54] MULTI-ADJUSTABLE DISPLAY CAP

[76] Inventor: Richard F. Gleason, Jr., 67 Stadium Way, Allston, Mass. 02134

[21] Appl. No.: 184,966

[22] Filed: Jan. 21, 1994

[51] Int. Cl.[6] ..... A42B 1/04

[52] U.S. Cl. ..... 40/329; 2/DIG. 2

[58] Field of Search ..... 40/329, 586; 2/171, 2/909, 918, 209.13, 209.14, 171.1, 172, 175.6, 195.2, DIG. 2; D2/893, 895

[56] References Cited

U.S. PATENT DOCUMENTS

| | | | |
|---|---|---|---|
| 859,736 | 7/1907 | Brown | 2/175.6 |
| 1,038,042 | 9/1912 | Wener | 2/209.13 |
| 1,538,847 | 5/1925 | Wheeler | 2/DIG. 2 X |
| 2,717,437 | 9/1955 | de Mestral . | |
| 2,986,743 | 6/1961 | Eilen . | |
| 3,438,062 | 4/1969 | Dobell . | |
| 3,484,974 | 12/1969 | Culmone . | |
| 4,630,317 | 12/1986 | Brown et al. | 2/909 X |
| 4,951,319 | 8/1990 | Phillips, Jr. et al. | 2/171 |
| 4,989,270 | 2/1991 | Boughten | 2/195.2 X |
| 5,003,640 | 4/1991 | Pizzacar | 2/195.2 X |
| 5,046,196 | 9/1991 | Sullivan | 2/909 X |
| 5,070,545 | 12/1991 | Tapia | 40/329 |
| 5,121,507 | 6/1992 | Brown | 2/195.2 X |
| 5,136,726 | 8/1992 | Kellin et al. | 2/171 X |
| 5,181,277 | 1/1993 | Sherman | 2/DIG. 2 X |

*Primary Examiner*—Kenneth J. Dorner
*Assistant Examiner*—Joanne Silbermann

[57] ABSTRACT

A multi-adjustable display cap includes a head covering with a display region of fabric conducive to releasable engagement with a hook element of a hook-and-loop type fastener set, the display region defining a display surface on an outside surface of the head covering, and a set of display elements each having a front surface and a rear attachment surface formed of a hook element of a hook-and-loop type fastener set for releasable attachment upon the display surface. One or more storage regions are provided on an inside surface of the head covering for removable storage of display elements, the storage regions being formed of a fabric conducive to releasable engagement with a hook element of a hook-and-loop type fastener set by releasable engagement of a hook element with the storage region.

3 Claims, 4 Drawing Sheets

MULTI-ADJUSTABLE DISPLAY CAP

BACKGROUND OF THE INVENTION

This invention relates to hats with displays.

Hats, e.g. golf caps, baseball caps and the like, typically carry a logo or display of other design on the outer front surface. These logos or designs are typically either permanently formed on the surface of the cap, e.g. by printing or embroidering, or fixedly attached thereto, e.g. by adhesive.

SUMMARY OF THE INVENTION

According to one aspect of the invention, a multi-adjustable display cap comprises a head covering defining a display region of fabric conducive to releasable engagement with a hook element of a hook-and-loop type fastener set, the display region defining a display surface on an outside surface of the head covering, and a set of one or more display elements, each display element having a front surface and a rear attachment surface formed of a hook element of a hook-and-loop type fastener set for releasable attachment upon the display surface, whereby the display cap is adapted for interchangeable display of a display element selected from a set of display elements by removable attachment of the display element upon the display surface.

Preferred embodiments of this aspect of the invention may include one or more of the following features. The display cap further comprises a storage region on an inside surface of the head covering for removable storage of display elements within the head covering, the storage region formed of a fabric conducive to releasable engagement with a hook element of a hook-and-loop type fastener set by releasable engagement of a hook element with the storage region. The storage region extends over the entire inside surface of the head covering. The display region extends over the entire outside surface of the head covering. The head covering is reversible to allow a wearer to display the inside surface and the outside surface of the head covering. Preferably, the inside surface exhibits a first pattern or color and the outside surface exhibits a second pattern or color different from the first pattern or color. The further comprises a bill adapted for separable attachment to the head covering, the bill comprising a region of fabric having hook elements conducive to releasable engagement with the display region. Preferably, the bill comprises a bill display region for removable display of a display element selected from the set of display elements, the bill display region formed of fabric conducive to releasable engagement with a hook element of a hook-and-loop type fastener set, whereby the display element is interchangeably displayed on the bill by removable attachment of the display element on the bill display region. More preferably, the bill display region completely covers an upper surface and a lower surface of the bill, the bill is reversibly attachable to the head covering, and a first surface of the bill displays a first pattern or color different from a second pattern or color exhibited by a second surface of the bill. The display cap further comprises a sweatband comprising a portion of fabric having back to back hook elements conducive to releasable engagement with the inside surface of the head covering, whereby the sweatband is adapted for removable attachment to the inside surface. Preferably, the portion of fabric extends over an entire surface opposed to the inside surface of the head covering when the sweatband is attached to the head covering. The display cap further comprises a neck cover comprising an attachment area of hook elements of a hook-and-loop type fastener set conducive to releasable attachment to an inner surface of the display cap formed of a fabric defining cooperative loop elements of a hook-and-loop type fastener set conducive to releasable engagement with the hook elements. Preferably, neck cover extends downwardly at least to a region of a collar of a wearer of the display cap. The head covering further comprises cooperative tabs extending parallel to the circumference of the head covering, a first one tab having a hook element of a hook-and-loop type fastener set, and a second tab having a loop element of the hook-and-loop type fastener set, whereby the circumference of the cap is adjustable by selective and removable attachment of the cooperative first and second tabs. The display cap further comprises a pair of ear muff elements, each ear muff element having a hook element of a hook-and-loop type fastener set adapted for inside storage and removable attachment upon the outer surface of the head covering in a position to cover a wearer's ears, and an adjustable strap assembly extending between the pair of ear muff elements beneath the wearer's chin.

According to another aspect of the invention, a multi-adjustable display cap comprises a head covering comprising an inside and outside surface, each surface formed of fabric conducive to releasable engagement with a hook element of a hook-and-loop type fastener set, the head covering being reversible, a bill comprising an upper surface, a lower surface, each upper and lower surface having fabric conducive to releasable engagement with a hook element of a hook-and-loop type fastener set, an inner end comprising fabric having hook elements conducive to releasable attachment to the outer surface of the head covering, the bill adapted for releasable and reversible attachment to the head covering, and a set of one or more display elements, each display element having a front surface and a rear attachment surface formed of a hook element of a hook-and-loop type fastener set for releasable attachment upon the display surface, whereby the display cap is adapted for interchangeable display of a display element selected from a set of display elements by removable attachment of the display element upon the display surface.

According to another aspect of the invention, a multi-adjustable display cap comprises a bill, a head covering formed of multiple panels and attached to the bill, at least one panel comprising a display region of fabric conducive to releasable engagement with a hook element of a hook-and-loop type fastener set, the display region defining a display surface on an outside surface of the head covering, a set of one or more display elements, each display element having a front surface and a rear attachment surface formed of a hook element of a hook-and-loop type fastener set for releasable attachment upon the display surface, whereby the multi-adjustable display cap is adapted for interchangeable display of a display element selected from a set of display element by removable attachment of the display element upon the display surface.

Preferred embodiments of this aspect of the invention may include one or more of the following features. The display region comprises a loop-type fabric element attached upon the outside surface of the head covering. The display cap further comprises a storage region on an inside surface of the head covering for removable storage of display elements within the head covering, the storage region formed of a fabric conducive to releasable engagement with a hook element of a hook-and-loop type fastener set by releasable engagement of a hook element with the storage region. Preferably, the storage region is attached to the inside surface of the head covering.

Objectives of the invention include providing an ornamental hat or cap which allows a wearer to select, from a set of display elements, one or more elements to be interchangeably displayed upon a surface of his or her cap, with other display elements releasably stored out of view on a surface within the cap. The user can thus easily change the displayed designs in order to "personalize" the display cap, and, in effect, to provide several hats in one.

These and other features and advantages of the invention will be seen from the following description of presently preferred embodiments, and from the claims.

DESCRIPTION OF THE PREFERRED EMBODIMENTS

Figure 1:
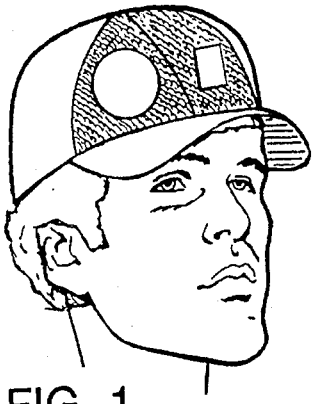
FIG. 1 is a perspective view of a multi-adjustable display cap of the invention.
Figure 2:
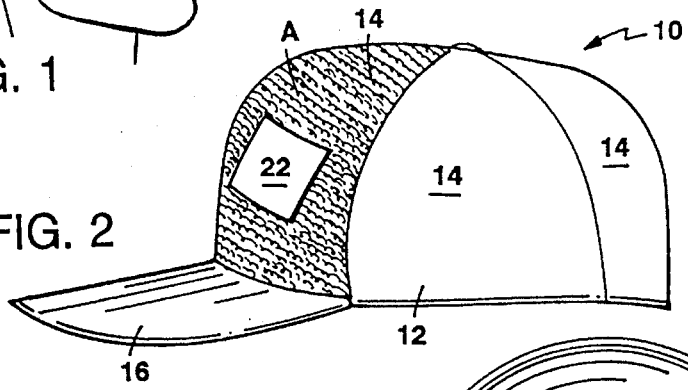
FIG. 2 is a side view of the cap of FIG. 1.
Figure 3:
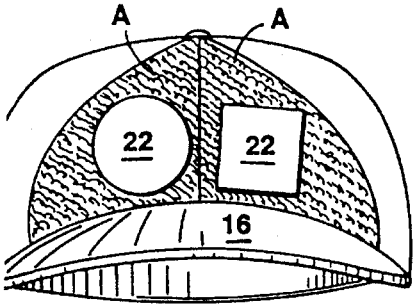
FIG. 3 is a front view of the cap of FIG. 1.

Referring to FIGS. 1 through 3, a multi-adjustable display cap 10 of the invention has a head covering or crown 12 formed of multiple panels 14, with a bill or visor 16. One or more of the panels 14 is formed of a loop-type fabric material conducive for releasable engagement with a cooperating hook element of a hook-and-loop type fastener set. For example, in the embodiment shown in the figures, two front panels, A, are formed of the loop-type material.

Figure 4:
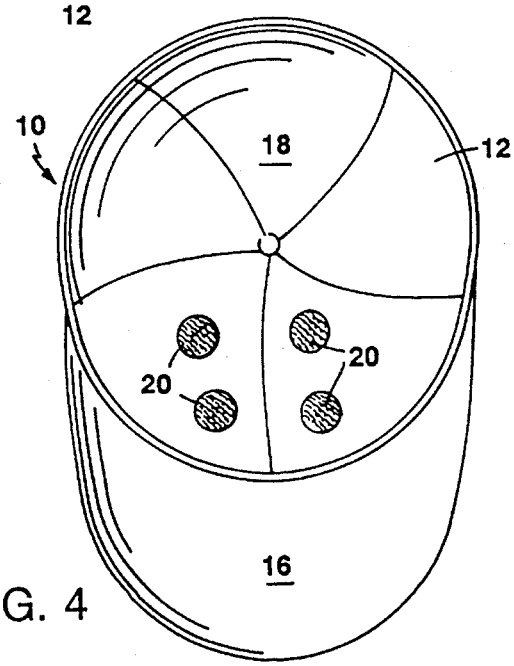
FIG. 4 is a bottom view of the cap of FIG. 1.
Figure 5:
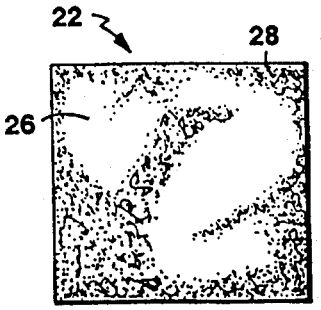
FIGS. 5, 6, and 7 are rear side and front views, respectively, of a display element for use with a cap of the invention.
Figure 6:
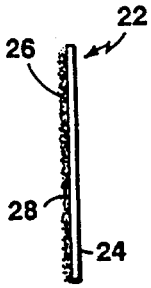
Figure 7:
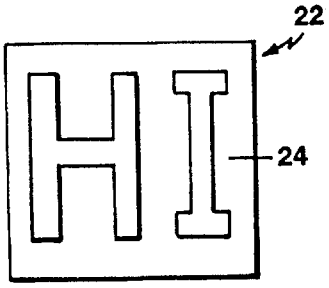

Referring also to FIG. 4, the inner surface 18 of the head covering 12 has one or more storage regions 20 also formed of a loop-type material conducive for releasable engagement with a hook element of a hook-and-loop type fastener set.

Referring now to FIGS. 4 through 7, the display cap 10 also includes a set of one or more display elements 22, each element having a front display surface 24 and a rear attachment surface 26, the rear surface having the form of a hook element 28 of a hook-and-loop type fastener set.

The display elements 22 may be formed in any usual manner, including but not limited to by silk screening designs onto a front display surface of hook element of a hook-and-loop type fastener set, by printing a design onto a substrate, e.g. paper, which is thereafter attached to the front display surface of a hook element of a hook-and-loop type fastener set, or by die-cutting or embroidering directly to a substrate, e.g. a hook element, or a double-sided loop element combined with a double-sided hook element, then formed and later separated.

In use, a wearer selects one or more display elements 22 from a virtually unlimited set of display elements for releasable attachment, in any desired arrangement, upon the outer display surface of panels A of the cap. Use of cooperative hook-and-loop type fastener sets permits the display elements to be arranged and interchanged repeatedly. Other display elements can be removably stored within the display cap by releasable engagement with storage regions 20 upon the inner surface of the cap.

Figure 8:
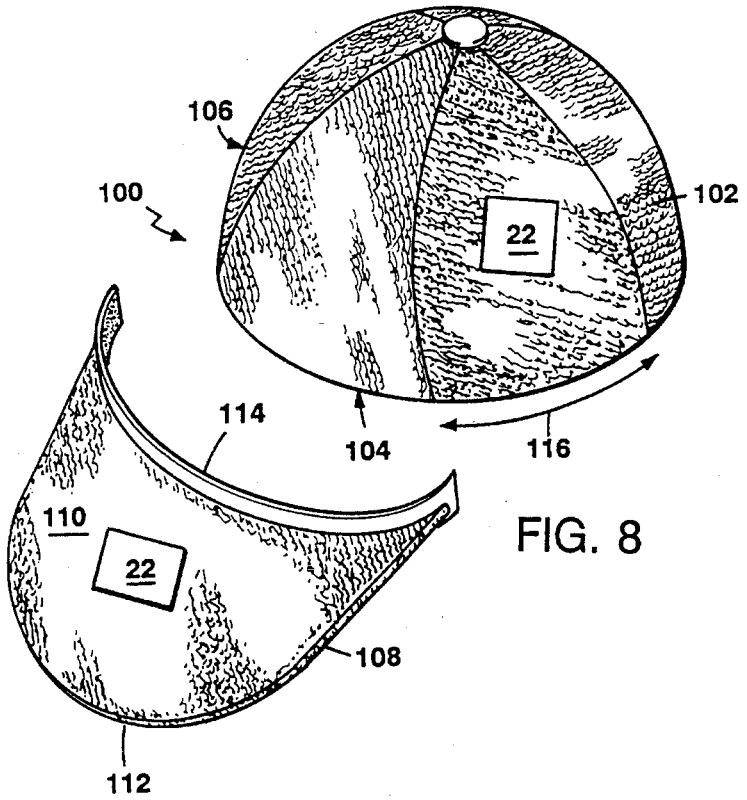
FIG. 8 is a perspective view of another embodiment of a multi-adjustable display cap of the invention.

In another preferred embodiment of the multi-adjustable display cap 100, shown in FIG. 8, both an inner surface 102 and an outer surface 104 of a head covering or crown 106 are formed of loop material conducive to engagement with the hook element of a hook and loop type fastener, e.g. VELCRO®. The crown may be worn alone, or together with a detachable bill or visor 108, with both surfaces 110, 112 also formed of loop material. Inner end 114 of the bill is curved to fit around circumference 116 of the crown and it is made of a hook material for releasable engagement with either surface 102, 104 of the crown. The bill can thus be attached to the crown at any point on its circumference.

Figure 9:
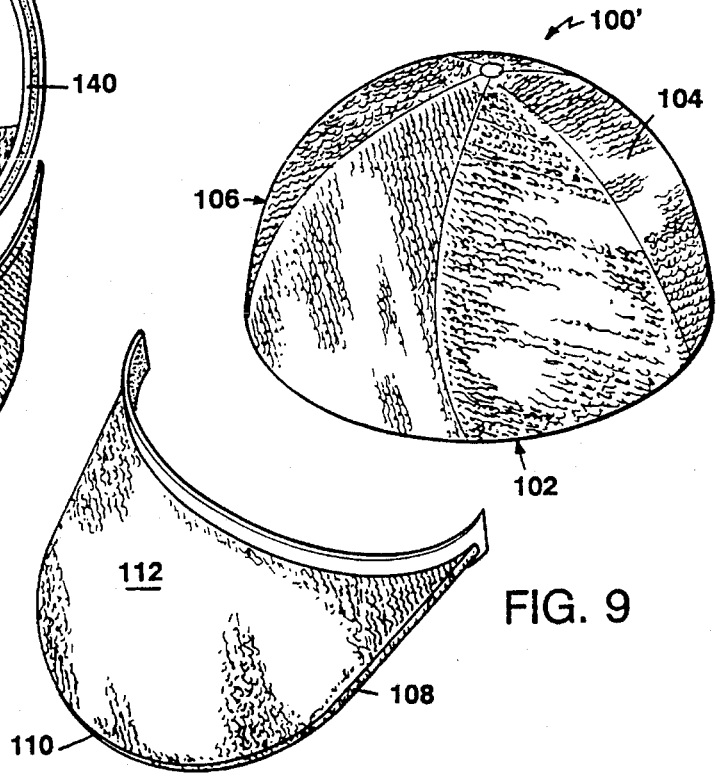
FIG. 9 is a perspective view of the cap of FIG. 8 when reversed.

The crown of the display cap is reversible, so that inner surface 104 may be turned out and displayed when worn. As shown in FIG. 9, the hook material on the inner end of the bill is attached to the loop material on the surface 104 of the crown of the reversed display cap 100'. The bill itself is also reversible, so that either surface 110 or 112 may be selected as the upper surface of the bill when worn.

In order to combine several styles of hats in one, each surface of the bill and crown are printed with a different pattern or color. For example, in military use, one surface of the cap and bill is printed with a camouflage pattern, and the opposite surface is either a dress or khaki color. By reversing the cap, a wearer can choose whether to display the camouflage pattern, or the dress or khaki pattern.

Returning to FIG. 8, the display cap 100 also includes display elements 22 (FIGS. 5–7) interchangeably and detachably displayed on outer surfaces 102, 110 of the crown and bill, while other display elements are stored on the inner surfaces 104, 112 of the crown and bill.

Figure 10:
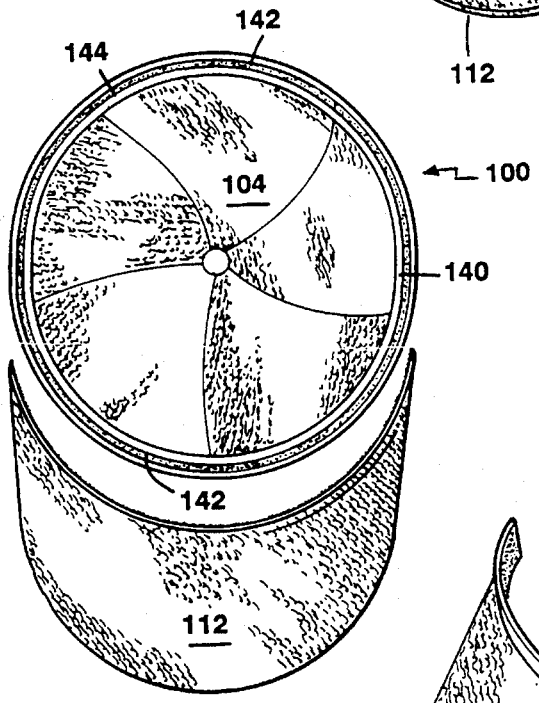
FIG. 10 is a bottom view of the cap of FIG. 8.
Figure 11:
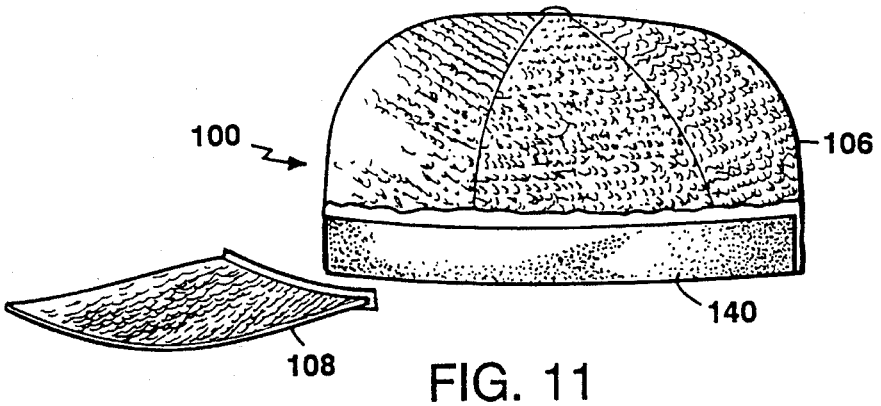
FIGS. 11 is a partially cut-away side view of the cap of FIG. 8.

The display cap also has an adjustable sweatband 140 (FIGS. 10 and 11) made of cotton, polyester or double sided hook fabric, with a strip of hook material 142 attached to the back surface for removable attachment to inner surface 104 of the cap. The sweatband, which can extend circumferentially up to 360° about the cap surface, is open-ended and attached to surface 102 of the crown in an identical manner when the cap is reversed. Alternatively, the outer side 144 of the sweatband, adjacent to the inner surface of the cap, is formed of hook material for releasable engagement with the loop material of a crown inner surface.

Figure 12:
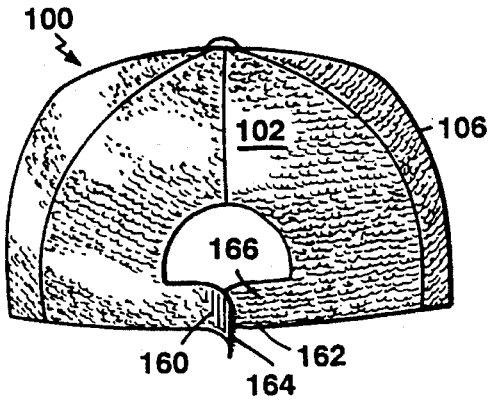
FIGS. 12 through 14 are rear views of the cap of FIG. 1.
Figure 15:
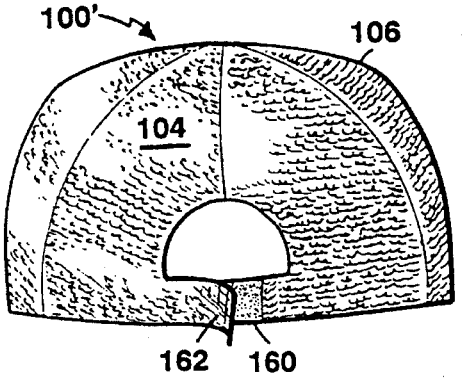
FIG. 15 is a rear view of the cap of FIG. 9.
Figure 13:
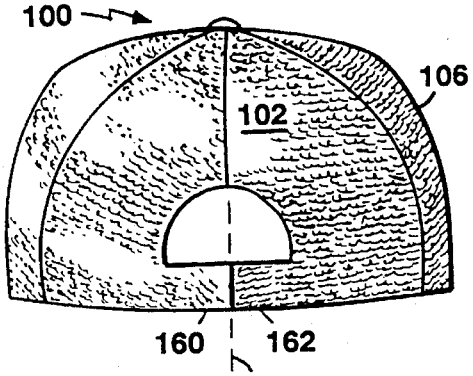
Figure 14:
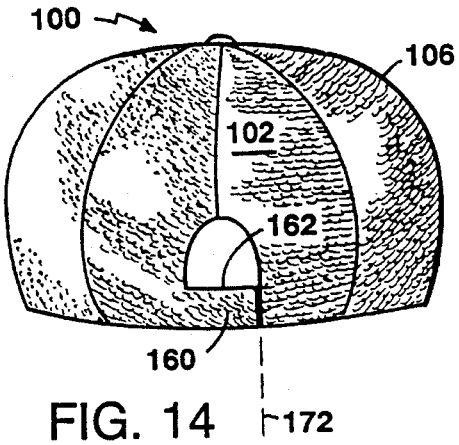

Referring now to FIGS. 12 through 14, the display cap is adjustable to any hat size by means of tabs 160, 162 formed on the crown. Tab 160 has surface 164 made of one element of a hook-and-loop type fastener set (e.g. hook elements) and tab 162 has surface 166 made of the cooperating element of a hook-and-loop type fastener set (e.g. loop elements). The tabs are removably fastened together in any of a number of positions to adjust the circumference of the cap. For example, when the tabs are attached in position 170 (FIG. 13), the circumference of the cap is larger than when the tabs are attached in position 172 (FIG. 14). When the display cap is reversed, as shown in FIG. 15, the tabs are fastened with tab 162 overlaying tab 160. The tabs may also have a pressure sensitive adhesive backing for application back-to-back over mesh fabric, e.g. for use in high temperature regions.

Figure 16:
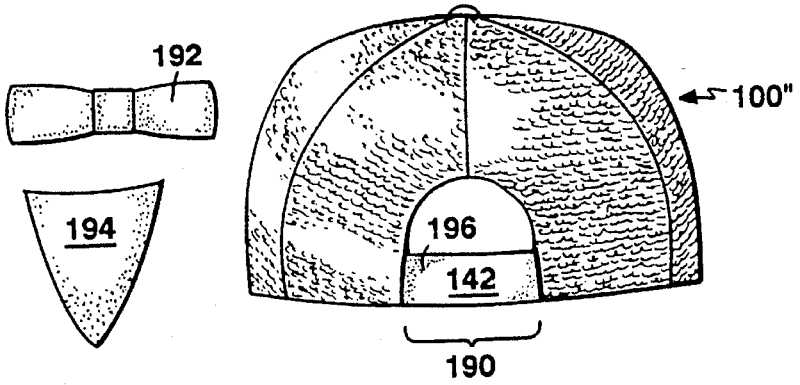
FIG. 16 is a rear view of another embodiment of a multi-adjustable display cap of the invention.
Figure 17:
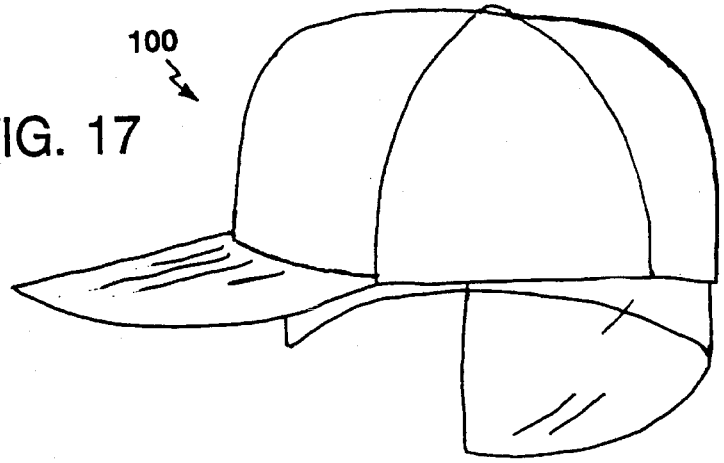
FIGS. 17 and 18 are perspective views of other embodiments of a multi-adjustable display cap of the invention.

Referring to FIG. 16, alternatively, the cap 100" is formed with a gap 190 at the rear and the sweatband 140 is positioned to extend across the gap in a manner to serve as the adjustment agent. A decorative looped material applique (such as a bow tie 192 or banner 194) may be removably attached upon the hooked element surface 196 exposed in the region of the gap.

Figure 18:
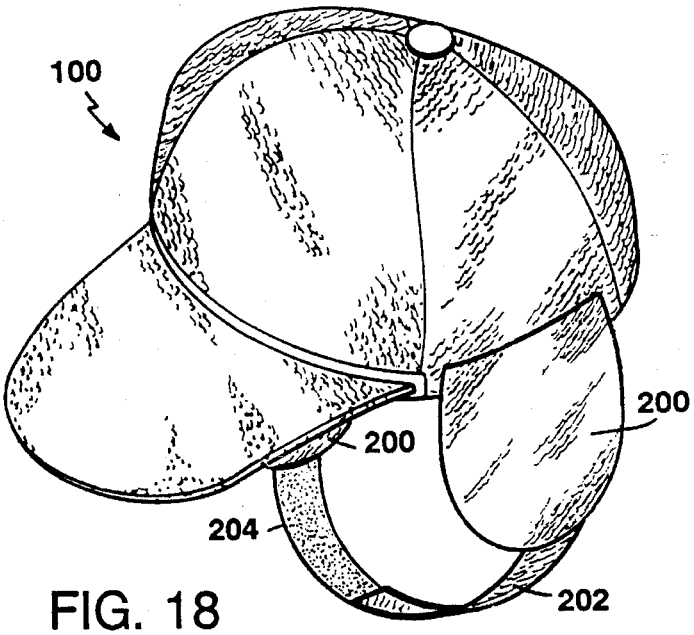

Referring to FIG. 18, a detachable pair of ear muffs 200 can be secured to the outer surface 104 of the cap 100 above a wearer's ears and joined by adjustable engagement of straps 202, 204 beneath the wearer's chin for secure positioning of the cap upon the head in stormy weather. The reversible muffs are stored inside the crown when not is use.

Other embodiments are within the following claims. For example, a display cap of the invention may take any form of head covering. Also, one or several regions of loop-type fabric material may be attached upon the outer and/or inner surface of an existing cap, e.g. by means of an adhesive.

What is claimed is:

1. A multi-adjustable display cap comprising a bill, a head covering formed of multiple panels and attached to said bill, at least one said panel being separable and comprising a display region of fabric conducive to releasable engagement with a hook element of a hook-and-loop type fastener set, said display region defining a display surface on an outside surface of said head covering, a set of one or more display elements, each display element having a front surface and a rear attachment surface formed of a hook element of a hook-and-loop type fastener set for releasable attachment upon said display surface, a storage region on an inside surface of said head covering for removable storage of display elements within said head covering, said storage region formed of a fabric conducive to releasable engagement with a hook element of a hook-and-loop type fastener set by releasable engagement of a hook element with said storage region, whereby said multi-adjustable display cap is adapted for interchangeable display of a display element selected from a set of display elements by removable attachment of said display element upon said display surface.

2. The display cap of claim 1, wherein said display region comprises a loop-type fabric element attached upon the outside surface of the head covering.

3. The display cap of claim 1, wherein said storage region is attached to the inside surface of the head covering.

* * * * *